United States Patent [19]

Jacobs, Jr. et al.

[11] 4,041,434

[45] Aug. 9, 1977

[54] COOLED ELECTRIC FUSE

[76] Inventors: Philip C. Jacobs, Jr., 53 Walden St., Newtonville, Mass. 02160; Erwin Salzer, P.O. Box 45, Waban, Mass. 02168

[21] Appl. No.: 708,396

[22] Filed: July 26, 1976

[51] Int. Cl.[2] ..... H01H 85/02

[52] U.S. Cl. ..... 337/204; 337/158; 337/227

[58] Field of Search ..... 337/277, 280, 282, 204, 337/203, 279, 158

[56] References Cited

U.S. PATENT DOCUMENTS

| | | | |
|---|---|---|---|
| 2,179,342 | 11/1939 | Muller | 337/277 |
| 3,183,330 | 5/1965 | Barkan et al. | 337/282 |
| 3,251,968 | 5/1966 | Cameron | 337/158 |
| 3,453,579 | 7/1969 | Cinquin | 337/203 |
| 3,921,116 | 11/1975 | Mikulecky | 337/279 |

*Primary Examiner*—Harold Broome

*Attorney, Agent, or Firm*—Erwin Salzer

[57] ABSTRACT

In fuses embodying this invention each of the terminal elements has a port for the passage of fluid through the casing of the fuse during normal operation thereof, i.e. while the fuse is carrying current. A tubular fusible element conductively interconnects said port in each of said terminal elements. The fuse further includes a toroidal body of quartz sand filling the space between said casing and said tubular fusible element. The fusible element has perforations covered by annular structures of electric insulating material precluding said quartz sand from penetrating into said tubular fusible element during the normal operation of said fuse. The fuse is further provided with a pair of check valves which open during normal operation of said fuse and then allow the flow of fluid through said tubular fusible element and close on occurrence of a build-up of a predetermined amount of pressure inside of said tubular fusible element and then inhibit said flow of fluid.

5 Claims, 5 Drawing Figures

COOLED ELECTRIC FUSE

BACKGROUND OF THE INVENTION

The ratio of peak let-through current I*p* to available current is a measure for the current-limiting action of a fuse. The smaller this ratio, the larger the current-limiting action.

Current-limiting action may be enhanced by a. subdividing the current path of the fuse into a large number of parallel current paths;

b. cooling of the fusible element by a flow of cooling medium to carry heat away by convection;

c. minimizing the thermal insulation of the fusible element, i.e. exposing the same to the cooling medium itself; and d. increasing the temperature gradient between the fusible element and the cooling medium.

It is the prime object of this invention to provide fuses which comply with these requirements. The cost of such equipment is higher than that of prior art equipment, but the result thereof justifies the increase in cost.

SUMMARY OF THE INVENTION

Fuses embodying this invention include a casing of electric insulating material and a pair of terminal elements each having a port for the passage of fluid through said casing during the normal current carrying operation of said fuse. A tubular fusible element conductively interconnects said port in each of said pair of terminal elements. A toroidal body of quartz sand is provided inside said casing and outside said tubular fusible element in physical contact with the latter. Said tubular fusible element has a plurality of perforations covered by annular means precluding said quartz sand from penetrating into said tubular fusible element during the normal operation of said fuse. The annular means which plugs the perforations against the escape of sand are permeable to fluid so that there is a mixture of sand and fluid in the toroidal space surrounding the tubular fusible element.

DESCRIPTION OF PREFERRED EMBODIMENT

Figure 1:
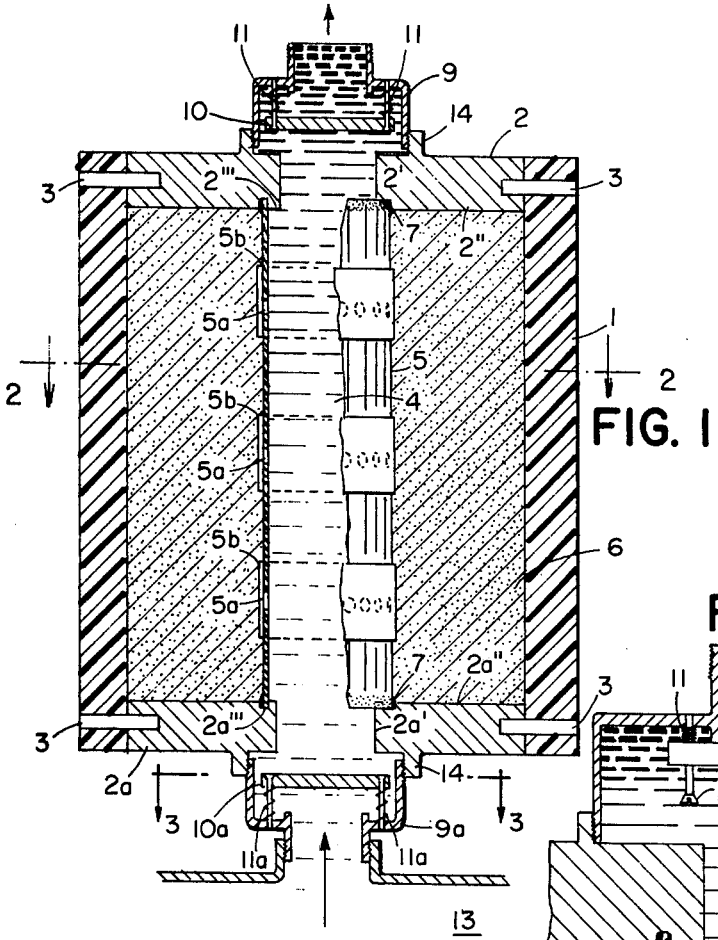
FIG. 1 is substantially a longitudinal section of a fuse embodying the present invention while the fuse is carrying current.
Figure 2:
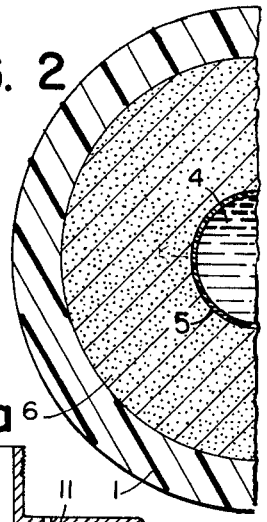
FIG. 2 is a cross-section of FIG. 1 taken along 2—2 of FIG. 1.

Referring now to the drawings, numeral 1 has been applied to indicate a tubular casing of electric insulating material. Casing 1 is closed on the ends thereof by a pair of terminal elements 2,2*a* which are affixed to casing 1 by means of steel pins 3. Terminal elements 2,2*a* have each a port 2′,2*a′* for the passage of fluid 4 through casing 1 during the operation of the fuse. A tubular fusible element 5 conductively interconnects the pair of terminal elements 2, 2*a* and allows the passage of said fluid 4 through fusible element 5. A filler of quartz sand 6 is arranged inside of casing 1 but outside of the space occupied by fusible element 5. Fusible element 5 defines perforations covered by woven structures of glass cloth having a sufficiently large mesh size to allow fluid 4 to flow from said fusible element 5 into the toroidal space outside thereof, but which are sufficiently small to preclude said filler of quartz sand 6 from flowing into the passage defined by fusible element 5.

The fusible element 5 includes three lines of perforations 5*a* of which each is covered by a strip of glass cloth 5*b*. Instead of glass cloth other materials which are pervious to fluid but keep the sand 6 out of the space defined by fusible element 5 may be used to obstruct the perforations 5*a* therein in regard to sand 6.

The axially inner end surfaces 2″,2*a″* of terminal elements 2,2*a* are provided with grooves 2‴,2*a‴* for receiving the axially outer ends of fusible element 5. The axially outer ends of fusible element 5 are soldered into said grooves as indicated at 7.

One of the terminal elements, namely element 2, is provided with a check valve 9 that is normally open and closes when there is a build-up of pressure inside said casing. Terminal element 2*a* is provided with a check valve 9*a* that operates in the same fashion as check valve 9.

During normal operation of the fuse valves 9,9*a* are opened by the action of springs 11,11*a*. Fluid 4 flows through fusible element 5 and thus cools the latter directly. Since the difference in temperature between fluid 4 and fusible element 5 may be considerable, the cooling of the latter will be considerable. The flow of fluid passes through perforations 5*a* in glass cloth rings 5*b* and completely saturates sand 6, but the flow of fluid 4 in sand 6 will be very slow in comparison to the flow of fluid inside fusible element.

When fusible element 5 melts, an arc bubble forms which consists substantially of hydrogen. Valves 9,9*a* close and the residual oil and gas is pressed radially outwardly into the body of quartz sand 6. There a fulgurite is formed. Since the fulgurite shunts the arc, the life of the former is very short. The fulgurite is a semi-conductor and its resistance increases therefore with falling temperature much more rapidly than, e.g., that of a metal. Thus the current comes rapidly down to zero.

Figure 4A:
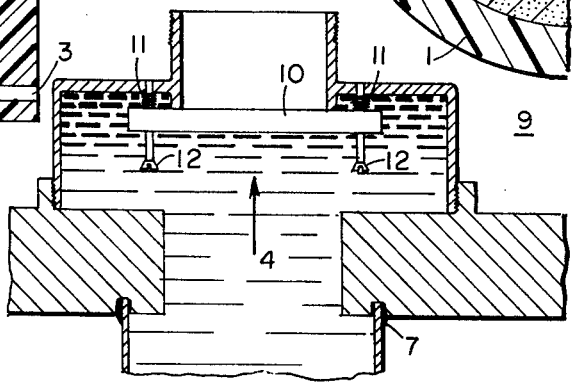
FIGS. 4*a* and 4*b* show diagrammatically the valves controlling the flow of fluid through the fusible element.
Figure 3:
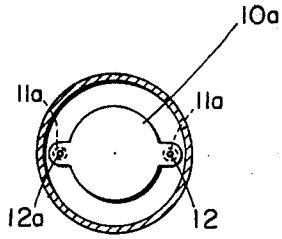
FIG. 3 is a cross-section of FIG. 1 taken along 3—3 thereof.
Figure 4B:
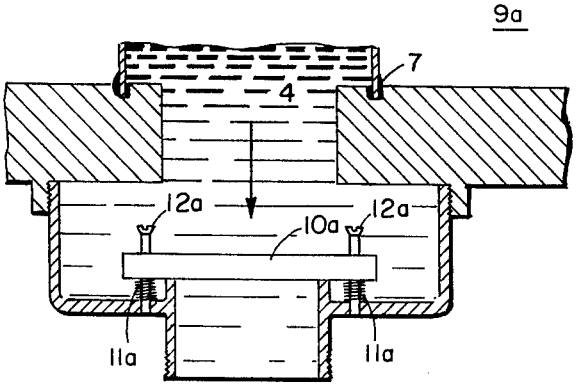

Valves 9,9*a* include valve bodies 10,10*a* acted upon by helical springs 11,11*a* which are supported by studs 12,12*a*. Pressure inside of the space defined by tubular fusible element 5 closed valves 9 and 9*a*, as clearly shown in FIGS. 4*a* and 4*b*.

The fluid 4 inside fusible element 5 may be oil, or any other appropriate fluid. Since the cooling medium 4 is in direct physical contact with the fusible element 5 and not separated from it by a layer of material, the temperature gradient and the cooling action are more intense than in prior art structure where these conditions do not prevail.

The size of the perforations 5*a* in the tubular fusible element 5 and that of the conductive bridges therebetween are of considerable importance. The number of perforations and of the bridges should be as large as possible, and the width of said bridges should not exceed the order of 0.010 inch.

Since heat transfer depends upon the temperature gradient, it may be desirable to cool the fluid medium before admitting it to casing 1 and the tubular conductor 5. Reference numeral 13 has been applied to diagrammatically indicate a heat exchanger where the temperature of the cooling medium may be reduced to any desired extent. The fluid after having left valve 9 is recirculated through heat exchanger 13 and valve 9*a*, so that there is a continuous circular flow of fluid cooling the fuse.

In the illustration of the invention shown there are two check valves 9 and 9*a*. In some instances the check valves may be omitted and flow restriction upon blowing of the fuse merely effected by appropriate reduction of the size of holes 2' and 2*a'*. The fusion of element 5 produces a shock wave which propagates in all directions and rather than only in the direction of apertures 2' and 2*a'* and this precludes excessive outflow of fluid and reduction of pressure inside of the fuse during the arcing time thereof. On the other hand, the closing of the fuse by valves 9 and 9*a* may result in generation of excessive pressures therein, i.e. of pressures which casing 1 may not be capable of withstanding, or which will drive terminal elements or terminal plugs 2 and 2*a* out of casing 1. This may call for the provision of an additional check valve which limits the pressure inside of the fuse, i.e. allows the escape of products of arcing if a given pressure is exceeded.

In the drawings check valves 9 and 9*a* are shown to be connected by three threads with collars 14 on terminals 2 and 2*a*. As a less desirable alternative, check valves 9 and 9*a* may be integral with fuse terminals or terminal plugs 2,2*a*.

We claim as our invention:

1. An electric current-limiting fuse including a. a casing of electric insulating material;

b. a pair of terminal elements closing the ends of said casing;

c. said pair of terminal elements each having a port for the passage of fluid through said casing during the normal current-carrying operation of said fuse;

d. a tubular fusible element conductively interconnecting said port in each of said pair of terminal elements;

e. a toroidal body of quartz sand inside said casing and outside said tubular fusible element in physical contact with said tubular fusible element;

f. said tubular fusible element having a plurality of perforations covered by annular means precluding said quartz sand from penetrating into said tubular fusible element during the normal operation of said fuse, and said annular means being permeable to fluid so that said body of quartz sand is immersed in said fluid during said normal current carrying operation of said fuse.

2. An electric current-limiting fuse as specified in claim 1 wherein said annular means are of glass cloth allowing fluid flowing through said tubular fusible element to enter the interstices between the particles forming said body of quartz sand, and said means of glass cloth having a sufficiently small mesh size to preclude particles of said body of quartz sand to enter into said tubular fusible element.

3. A current-limiting fuse as specified in claim 1 wherein each of the axially inner end surfaces of said pair of terminal elements is provided with an annular groove each receiving one of the axially outer ends of said tubular fusible element, and wherein each of the axially outer ends of said tubular fusible element are soldered into said groove.

4. A current-limiting fuse as specified in claim 1 including a pair of check valves of which one is arranged to control said port in each of said pair of terminal elements, said pair of check valves being open during normal operation of said fuse and then allow the flow of fluid through said tubular fusible element and close on occurrence of a build-up of a predetermined amount of pressure inside of said tubular fusible element and then inhibit said flow of fluid.

5. A current-limiting fuse as specified in claim 1 wherein at least one of said pair of terminal elements is provided with a separate check valve which is open during normal current carrying operation of said fuse and closes on occurrence of a predetermined amount of pressure inside said tubular fusible element.

* * * * *